US010868400B1

(12) United States Patent
Brannon

(10) Patent No.: US 10,868,400 B1
(45) Date of Patent: Dec. 15, 2020

(54) CLAMPING LIGHT BULB

(71) Applicant: Shirley Brannon, Martinsburg, WV (US)

(72) Inventor: Shirley Brannon, Martinsburg, WV (US)

( * ) Notice: Subject to any disclaimer, the term of this patent is extended or adjusted under 35 U.S.C. 154(b) by 0 days.

(21) Appl. No.: 16/248,053

(22) Filed: Jan. 15, 2019

Related U.S. Application Data

(60) Provisional application No. 62/617,415, filed on Jan. 15, 2018.

(51) Int. Cl.

| | |
|---|---|
| ***H01R 33/18*** | (2006.01) |
| ***F21V 23/06*** | (2006.01) |
| ***H01R 13/44*** | (2006.01) |
| ***H01R 13/24*** | (2006.01) |
| ***H01R 33/22*** | (2006.01) |

(52) U.S. Cl.
CPC ..... *H01R 33/18* (2013.01); *F21V 23/06* (2013.01); *H01R 13/2457* (2013.01); *H01R 13/44* (2013.01); *H01R 33/22* (2013.01)

(58) Field of Classification Search
CPC .... H01R 33/18; H01R 13/2457; H01R 13/44; H01R 33/22; F21V 23/06
USPC ..... 362/457
See application file for complete search history.

(56) References Cited

U.S. PATENT DOCUMENTS

| | | | | |
|---|---|---|---|---|
| 4,886,994 | A * | 12/1989 | Ragge, Jr. | F21V 19/006 313/318.1 |
| 7,063,555 | B1 | 6/2006 | Mullen | |
| 8,067,893 | B2 | 11/2011 | Markel | |
| 8,668,504 | B2 | 3/2014 | Cofini | |
| 9,768,571 | B1 * | 9/2017 | Peng | H01R 33/22 |
| 2006/0252295 | A1 * | 11/2006 | Mazzarelli | H01R 33/18 439/353 |
| 2008/0239758 | A1 | 10/2008 | Ng | |

* cited by examiner

*Primary Examiner* — Cara E Rakowski
*Assistant Examiner* — Jessica M Apenteng
(74) *Attorney, Agent, or Firm* — Cramer Patent & Design, PLLC; Aaron R. Cramer

(57) ABSTRACT

A light bulb having a tapering base with a circumferential clip providing the electrical and mechanical attachment to a conventional socket. The clip includes a circumferential band and a pair of diametrically opposing spring clips that, when simultaneously pressed inward, serve to compress the circumferential band, thereby enabling removal of the light bulb from the socket.

8 Claims, 4 Drawing Sheets

CLAMPING LIGHT BULB

RELATED APPLICATIONS

The present invention was first described in and claims the benefit of U.S. Provisional Application No. 62/617,415 filed Jan. 15, 2018, the entire disclosures of which are incorporated herein by reference.

FIELD OF THE INVENTION

The present invention relates to a clamping light bulb.

BACKGROUND OF THE INVENTION

The common Edison-style lamp base has been in place for generations. While the lamp technology itself has changed over time from incandescent, to fluorescent and most recently LED, the method in which the lamp is installed and removed from the socket has remained unchanged. Another aspect of lighting that has changed is the fixtures themselves. Once what was simple ceramic sockets or table lamps have now progressed to fixtures with complicated globes, recessed fixtures with limited access, and greatly elevated fixtures which are hard to reach, much less turn and remove lamps. It is not an uncommon occurrence to have a lamp break due to over tightening, or stop working because it was not tightened enough.

Accordingly, there exists a need for a means by which the method of lamp insertion and removal from Edison-style sockets can be improved to address the above-mentioned shortcomings. The use of the clamping light bulb provides an easier method of lamp installation and removal in manner which still utilizes Edison-style sockets.

SUMMARY OF THE INVENTION

The inventor has recognized the aforementioned inherent problems and lack in the art and observed that there is a need for an a lamp base with a removal device, comprising a lamp body having a type of lighting that contains one or more conductors, one or more insulators, and one or more filaments, a base section through which the one or more conductors being associated with the lamp base are terminated, a bottom contact protrusion providing a first electrical connection. The first electrical connection proximal to the lamp body and the first electrical connection is insulated from the base section via the bottom contact protrusion. The first electrical connection provides electrical contact to a lighting circuit via a socket bottom contact. The is also a second electrical connection connected to a terminal cap, the terminal cap forms the base section of the lamp body and a pair of spring contacts each having a distal end, the pair of spring contacts connected to the terminal cap by a metal to metal fastening method, an upper portion of the pair of spring contacts are provided with an insulating material to prevent accidental contact and possible electrocution should the spring contacts be touched while the lamp base with removal device is energized, the pair of spring contacts provide electrical contact and retention capability against a socket sidewall.

The type of lighting may be selected from the group consisting of incandescent lighting, fluorescent lighting, light-emitting diode lighting, high intensity discharge lighting, or neon lighting. The bottom contact protrusion may be made of a non-conducting material selected from the group consisting of plastic, glass, or Bakelite. The first electrical connection is isolated from the base section via the insulating properties of the bottom contact protrusion. The pair of spring contacts are provided parallel to a side of the terminal cap and possess a zig-zag profile or the pair of spring contacts are located at one hundred eighty degrees from each other and are of a sufficient width to form a structurally stable and electrically conductive surface.

The metal to metal fastening method is welding or brazing. The sufficient width is one-eighth of an inch. The distal ends are coated with the insulating material so as to not afford electrical contact to a user. The user maybe protected from electrical properties of the pair of spring contact via the insulating material, should the lamp base with removal device the is changed while the lighting circuit is still active.

The insulating material may be made of plastic or rubber. The lamp base with removal device is installed in a lamp socket in a conventional manner and may be installed in a lighting device selected from the group consisting of a lighting fixture, a string fixture, a wall sconce, a work light, a seasonal lighting device, or a temporary lighting device.

A method for installing a lamp base with removal device, comprising the steps of de-energizing a lighting circuit; removing an existing lamp from a lamp socket; inserting the lamp base with removal device into the lamp socket; and reenergizing the lighting circuit. The inserting step is applying mild force along a first line of force with the lamp base with removal device in axial alignment with the lamp socket. Application of the first line of force stops when the lamp base with removal device is firmly seated.

A method for removing a lamp base with removal device, comprising the steps of de-energizing a lighting circuit, grasping a lamp body of the lamp base with removal device, withdrawing the lamp base with removal device and leaving a lamp socket of the lamp base with removal device empty for replacement by another lighting device.

The lamp body is grasped with a palm of a user's hand, while the user's thumb and forefinger apply pressure along a line of force to a pair of spring contacts while insulated by an insulating material.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
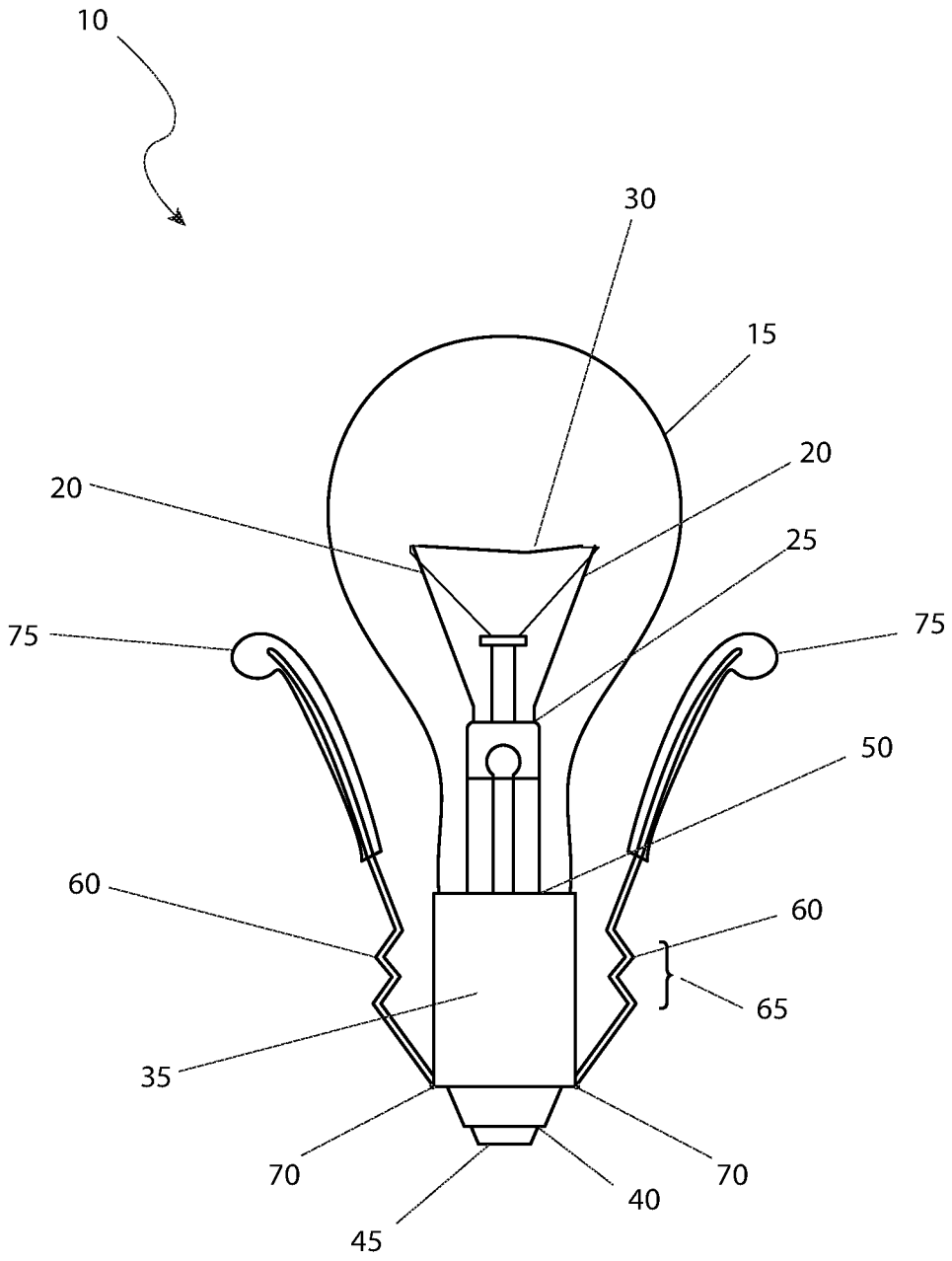
FIG. 1 is a front view of the lamp base with removal device 10, according to the preferred embodiment of the present invention.

10 lamp base with removal device
15 lamp body
20 conductor
25 insulator

30 filament
35 base section
40 bottom contact protrusion
45 first electrical connection
50 second electrical connection
55 terminal cap
60 spring contact
65 zig-zag profile
70 metal to metal fastening method
75 insulating material
80 lamp socket
85 first line of force
90 second lines of force
95 socket sidewall
100 socket bottom contact
105 electrical wiring connections

DESCRIPTION OF THE INVENTION

The best mode for carrying out the invention is presented in terms of its preferred embodiment, herein depicted within FIGS. 1 through 4. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a front view of a lamp base with removal device 10, according to the preferred embodiment of the present invention is disclosed. The lamp base with removal device 10 (herein also described as the "device") 10, includes a lamp body 15. The lamp body 15 is depicted as an incandescent lamp for purposes of illustration and thus contains conductors 20, insulators 25, and filaments 30. However, other types of lighting may also benefit from the teachings of the device 10, including fluorescent, light-emitting diode (LED), high intensity discharge (HID), neon, and the like. As such, the type of lighting utilized with the device 10 is not intended to be a limiting factor of the present invention.

The device 10 is provided with a base section 35 through which the conductors 20 associated with the lamp technology are terminated. A bottom contact protrusion 40, similar in size and location to that found on a conventional Edison-style lamp base provides for a first electrical connection 45. A second electrical connection 50 is connected to a terminal cap 55 which forms the base of the lamp body 15. The terminal cap 55 assumes the primary presence and functionality of the typical threaded base on a conventional lamp assembly. Two (2) spring contacts 60 are provided parallel to the side of the terminal cap 55 and possess a zig-zag profile 65 similar in profile to that of a conventional thread pattern on an Edison-style base. The spring contacts 60 are connected to the terminal cap 55 by a metal to metal fastening method 70 such as welding, brazing, or the like. The upper portion of the spring contacts 60 are provided with an insulating material 75 to prevent accidental contact and possible electrocution should the spring contacts 60 be touched while the device 10 is energized.

Figure 2:
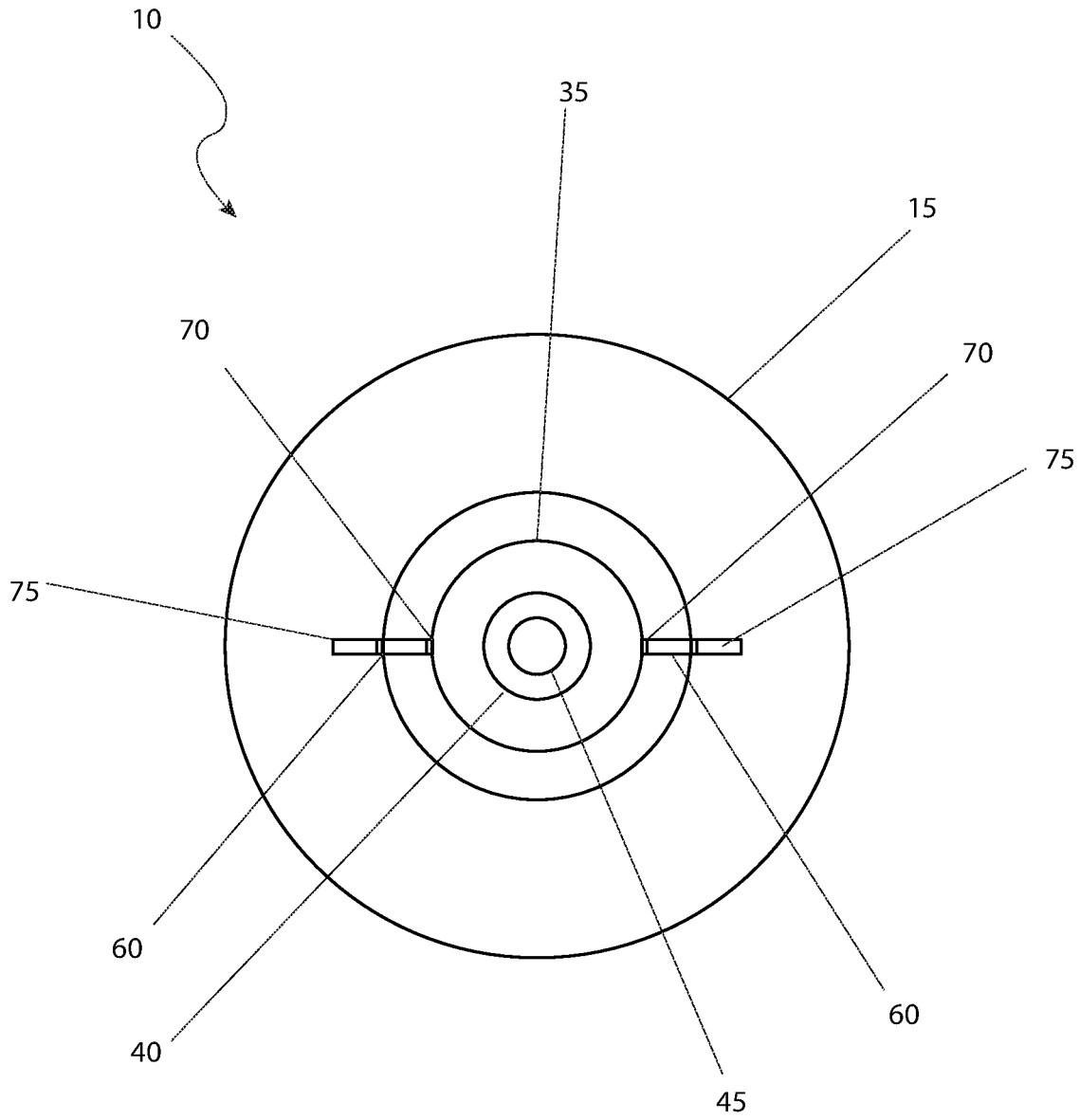
FIG. 2 is a bottom view of the lamp base with removal device 10, according to the preferred embodiment of the present invention.

Referring next to FIG. 2, a bottom view of the device 10, according to the preferred embodiment of the present invention is depicted. This view clearly depicts the lamp body 15 at a distal configuration with the first electrical connection 45 located proximally. The first electrical connection 45 is insulated from the base section 35 via the bottom contact protrusion 40 envisioned to be manufactured from a non-conducting material such as plastic, glass, Bakelite, or the like. The two (2) spring contacts 60 are located at one hundred eighty degrees (180°) from each other and are of a sufficient width, such as one-eighth of an inch (⅛ in.), to form a structurally stable and electrically conductive surface. The insulating material 75 coats the distal ends of each spring contact 60 so as to not afford electrical contact to the user as afore mentioned described. The insulating material 75 would be made of plastic, rubber, or other suitable material.

Figure 3:
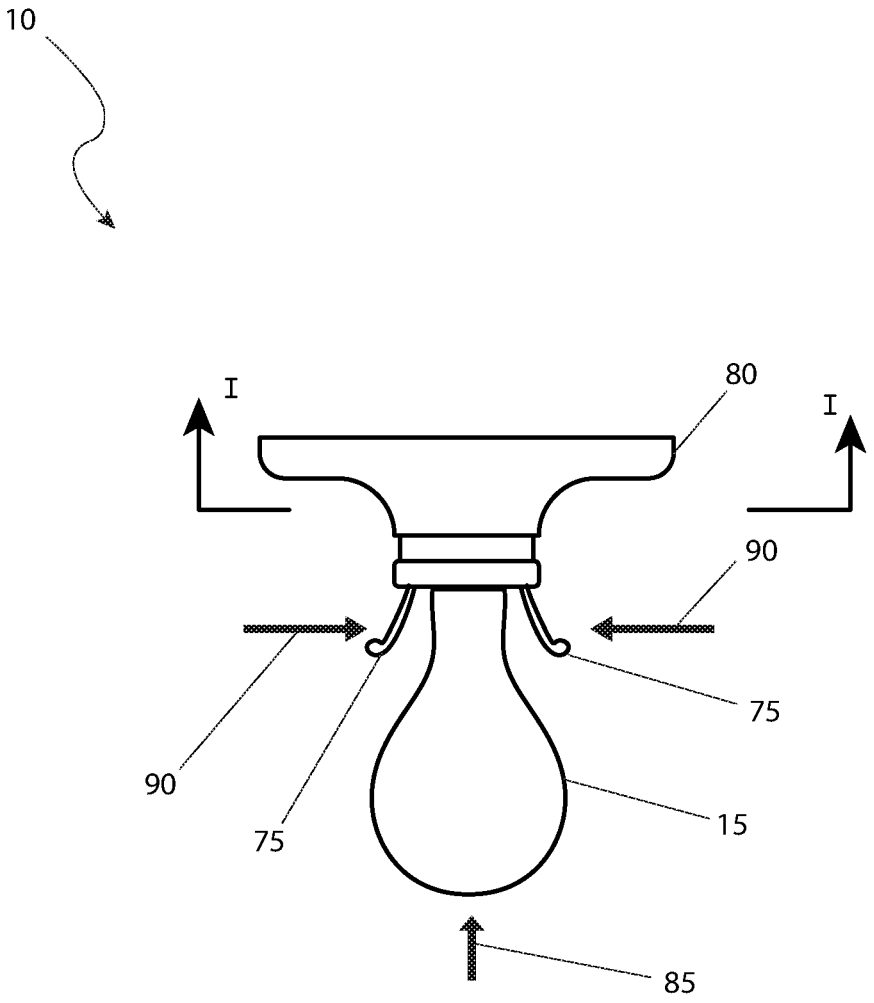
FIG. 3 is a side view of the lamp base with removal device 10, shown in an installed state, according to the preferred embodiment of the present invention; and, FIG. 4 is a sectional view of the lamp base with removal device 10, as seen along a line I-I, as seen in FIG. 3 according to the preferred embodiment of the present invention.

Referring now to FIG. 3, a side view of the device 10, shown in an installed state, according to the preferred embodiment of the present invention is shown. The device 10 is installed in a lamp socket 80 in a conventional manner. The lamp socket 80 is portrayed in FIG. 3 as a typical porcelain lamp socket for illustrative purposes. However, it is noted that the device 10 will work in all types of Edison-style lamp bases including those in all types of lighting fixtures, string fixtures, wall sconces, work lights, seasonal lighting, temporary lighting, and the like. During insertion of the device 10 into the lamp socket 80 a first line of force 85 will be applied to the lamp body 15 using their hand. This linear force afforded by the first line of force 85 is noted to be in stark contrast to the rotational force utilized with conventional light bulbs and is envisioned to be easier to accomplish for those with dexterity issues. During the application of the first line of force 85, the spring contacts 60 (as shown in FIG. 1) will self-bend as required to allow for insertion, and at completion of insertion, will allow for retention of the device 10 within the lamp socket 80. During removal of the device 10 from the lamp socket 80, second lines of force 90 is applied by the user, preferably by their fingers, to the point where the insulating material 75 contacts the lamp body 15. It is envisioned that the user's hand, in a cupped configuration, while still maintaining second lines of force 90 with their fingers, will guide the device 10 free from the lamp socket 80. This force required by the removal process is noted to be in stark contrast to the rotational force utilized with conventional light bulbs and is envisioned to be easier to accomplish for those with dexterity issues.

Figure 4:
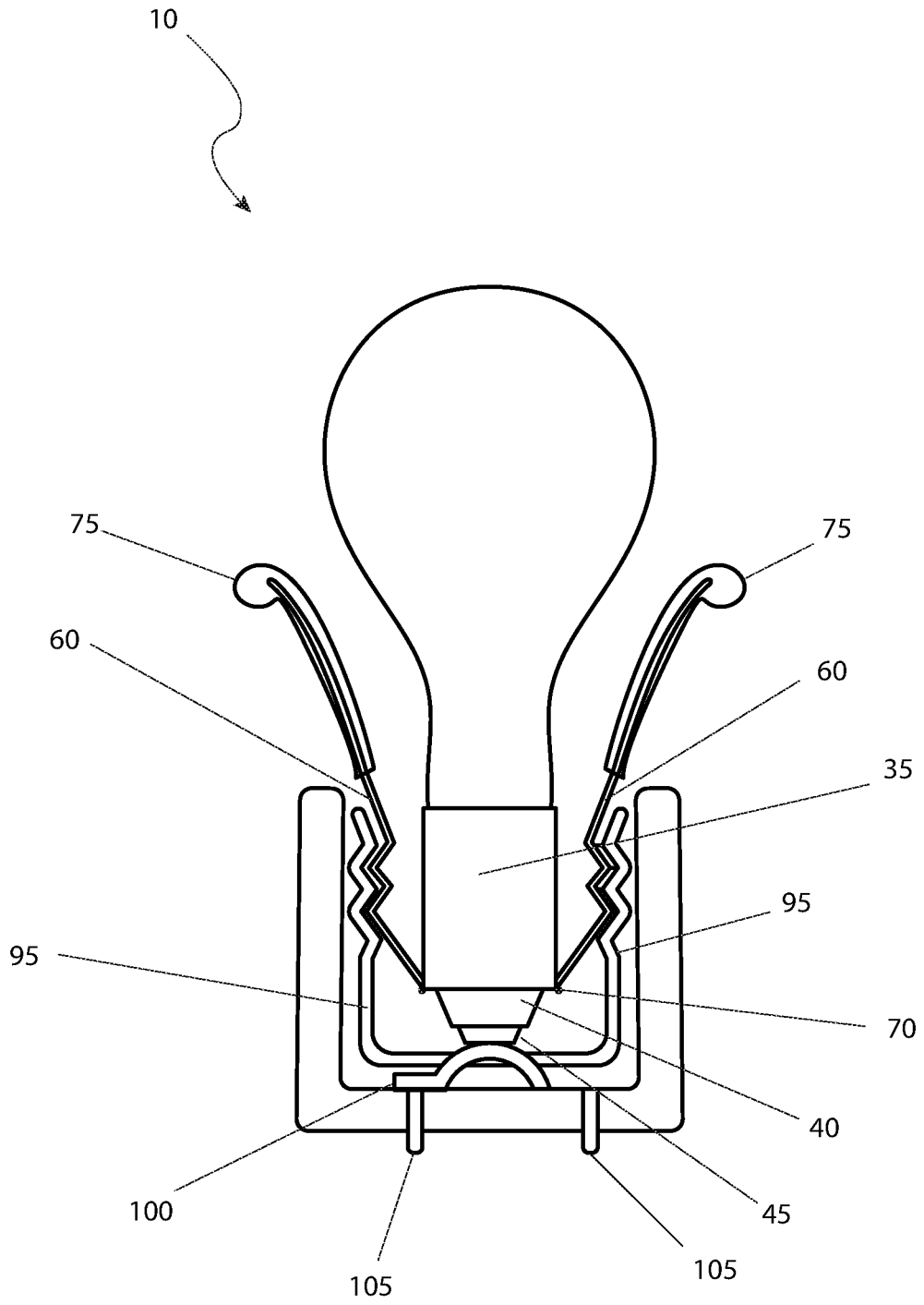

Referring to FIG. 4, a sectional view of the device 10, as seen along a line I-I, as seen in FIG. 3, according to the preferred embodiment of the present invention is disclosed. The spring contacts 60 provide electrical contact and retention capability against a socket sidewall 95. The first electrical connection 45 provides electrical contact to the lighting circuit via a socket bottom contact 100, noting that the first electrical connection 45 is isolated from the base section 35 via the insulating properties of the bottom contact protrusion 40. The spring contacts 60 are electrically conductive and are electrically joined to the base section 35 via the metal to metal fastening method 70. As aforementioned noted, the user is protected from the electrical properties of the spring contacts 60 via the insulating material 75, should the device 10 be changed while the lighting circuit is still active. Electrical wiring connections 105 are utilized to complete the lighting circuit in a conventional manner.

2. Operation of the Preferred Embodiment

The preferred embodiment of the present invention can be utilized by the common user in a simple and effortless manner with little or no training. It is envisioned that the device 10 would be constructed in general accordance with FIG. 1 through FIG. 4. The user would procure the device 10 paying particular regard to the type of lighting technology employed (incandescent, fluorescent, LED, etc.) as well as other lamp parameters such as voltage, wattage, lamp temperature, etc. Such decisions are the same employed when procuring conventional electric lamps without the teachings of the device 10.

During installation of the device 10, the following procedure would be initiated: the lighting circuit would be de-energized; any existing lamp would be removed from the lamp socket 80 following normal removal procedures; the device 10 would be inserted into the lamp socket 80 by applying mild force along the first line of force 85 with the device 10 in axial alignment with the lamp socket 80; the application of force stops when the device 10 is firmly seated; finally, the lighting circuit is re-energized. The use of the device 10 is then identical to that of a conventional Edison-style base lamp.

During removal of the device 10; the following procedure would be initiated; the lighting circuit would be de-energized; the user would grasp the lamp body 15 with the palm of their hand, while their thumb and forefinger applies pressure along the second lines of force 90 to the two (2) spring contacts 60 while insulated by the insulating material 75. The device 10 is then withdrawn leaving the lamp socket 80 empty for replacement by another device 10 or a conventional Edison-style base lamp. Such a process of removal and replacement continues in a circular manner as needed.

It is noted that the device 10 provides multiple benefits including but not limited to: improving usability especially in space limited fixtures where rotating conventional Edison-style base lamps is difficult; eliminating over and under tightening and associated lamp breakage; usage by those with limited mobility such as the elderly, disabled, those suffering from arthritis or the like; usage during cold weather by those with gloved hands; and use with seasonal decorations that require interchanging of lamps on a frequent basis. It is also noted that the teachings of the device 10 does not require any modification of the lamp socket 80 and allows for conversion back and forth to conventional bulbs without permanent modification.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A lamp base with removal device, comprising:

a lamp body having a type of lighting that contains one or more conductors, one or more insulators, and one or more filaments;

a base section through which said one or more conductors associated with said lamp base are terminated;

a bottom contact protrusion providing a first electrical connection, said first electrical connection proximal to said lamp body and said first electrical connection is insulated from said base section via said bottom contact protrusion, said first electrical connection provides electrical contact to a lighting circuit via a socket bottom contact;

a second electrical connection connected to a terminal cap, said terminal cap forms said base section of said lamp body; and a pair of spring contacts each having a distal end, said pair of spring contacts connected to said terminal cap, an upper portion of said pair of spring contacts are provided with an insulating material to prevent accidental contact and possible electrocution should said spring contacts be touched while said lamp base with removal device is energized, said pair of spring contacts provide electrical contact and retention capability against a socket sidewall;

wherein said type of lighting is selected from the group consisting of incandescent lighting, fluorescent lighting, light emitting diode lighting, high intensity discharge lighting, or neon lighting;

wherein said bottom contact protrusion is made of a non-conducting material selected from the group consisting of plastic, glass, or Bakelite;

wherein said pair of spring contacts are provided parallel to a side of said terminal cap and possess a continuous zig-zag profile;

wherein said pair of spring contacts are located at one hundred eighty degrees from each other and are of a sufficient width to form a structurally stable and electrically conductive surface; and wherein said sufficient width is one-eighth of an inch to form a structurally stable and electrically conductive surface.

2. The lamp base with removal device according to claim 1, wherein said pair of spring contacts are welded to said terminal cap.

3. The lamp base with removal device according to claim 1, wherein said pair of spring contacts are brazed to said terminal cap.

4. The lamp base with removal device according to claim 1, wherein said distal ends are coated with said insulating material so as to not afford electrical contact to a user.

5. The lamp base with removal device according to claim 4, wherein said user is protected from electrical properties of said pair of spring contact via said insulating material, should said lamp base with removal device said is changed while said lighting circuit is still active.

6. The lamp base with removal device according to claim 5, wherein said insulating material is made of plastic.

7. The lamp base with removal device according to claim 1, wherein said lamp base with removal device is installed in a lamp socket in a conventional manner.

8. The lamp base with removal device according to claim 7, wherein said lamp base with removal device is installed in a lighting device selected from the group consisting of a lighting fixture, a string fixture, a wall sconce, a work light, a seasonal lighting device, or a temporary lighting device.

* * * * *